US005967220A

United States Patent [19]

Lauener

[11] Patent Number: 5,967,220

[45] Date of Patent: Oct. 19, 1999

[54] CASTER INCLUDING A GAS DELIVERY MEANS TO RESIST BACKFLOWING AND FREEZING OF MOLTEN METAL TO THE TIP OF A NOZZLE

[75] Inventor: Wilhelm F. Lauener, Gerlafingen/SO, Switzerland

[73] Assignee: Larex, A.G., Recherswil, Solothurn, Switzerland

[21] Appl. No.: 08/823,915

[22] Filed: Mar. 25, 1997

[51] Int. Cl.[6] ..... B22D 11/16; B22D 41/50

[52] U.S. Cl. ..... 164/154.8; 164/415; 164/432; 164/437; 222/591; 222/595; 222/603

[58] Field of Search ..... 164/475, 415, 164/431, 432, 481, 479, 437, 488, 133, 452, 154.8; 222/590, 595, 591, 603

[56] References Cited

U.S. PATENT DOCUMENTS 3,552,478 1/1971 Lauener ..... 164/133
4,785,873 11/1988 Lauener ..... 164/481
4,794,978 1/1989 Lauener ..... 164/431
4,798,315 1/1989 Lauener ..... 222/591
4,964,456 10/1990 Lauener ..... 164/481
5,190,674 3/1993 Monks ..... 222/590
5,711,367 1/1998 Lauener ..... 164/437

*Primary Examiner*—Harold Pyon
*Assistant Examiner*—I.-H. Lin
*Attorney, Agent, or Firm*—David W. Brownlee; David V. Radack; Charles Q. Buckwalter

[57] ABSTRACT

A caster including a device for delivering a gas into a space created by the apparatus that define the mold of the caster and the nozzle of the caster. Introducing a gas into the space resists backflowing and freezing of the molten metal to the nozzle.

15 Claims, 5 Drawing Sheets

CASTER INCLUDING A GAS DELIVERY MEANS TO RESIST BACKFLOWING AND FREEZING OF MOLTEN METAL TO THE TIP OF A NOZZLE

BACKGROUND OF THE INVENTION

This invention relates to a caster including a gas delivery means to resist backflowing and freezing of molten metal to the tip of a nozzle and an associated method.

Casters for casting molten metal, such as molten aluminum, into metal products are known. Molten metal is typically introduced into the caster from a trough that is fed from a furnace. Typically, a nozzle introduces the molten metal into the mold of the caster. In a twin belt caster, the mold is formed by a pair of opposed movable belts and a pair of opposed side dams. A metal product, such as a slab, is formed in the mold by solidifying the molten metal. An example of a twin belt caster is described in U.S. Pat. No. 4,964,456.

A recurring problem with casters utilizing a nozzle is that molten metal can freeze at the nozzle tip. This freezing of molten metal at the nozzle tip causes undesirable surface qualities in the cast slab. In addition, freezing of molten metal at the nozzle tip can cause nozzle damage.

Also, despite the known devices to seal the belt to the nozzle (see, e.g., U.S. Pat. No. 4,785,873) a space can form between the nozzle and the belt, and molten metal can enter this space, and thereafter freeze to the nozzle tip.

What is needed, therefore, is a caster that includes means for resisting freezing and backflowing of molten metal to the nozzle tip. By resisting this freezing and backflowing of molten metal to the nozzle tip, a higher quality cast metal product can be produced in the caster.

SUMMARY OF THE INVENTION

The invention has met or exceeded the above-mentioned needs as well as others. The caster of the invention comprises means for defining a mold to receive molten metal therein and a nozzle for delivering the molten metal into the mold. The nozzle includes a tip. The caster further includes means for delivering a gas to a space defined by the mold defining means and the nozzle. In this way, freezing and backflowing of the molten metal near the tip is resisted.

The method of the invention includes providing a caster substantially as described above and solidifying the molten metal into a metal product in the mold of the caster. The method further comprises introducing a gas into the space defined by the nozzle and the mold defining means while the molten metal is solidifying in the mold. Once again, the introduction of the gas into the space resists freezing and backflowing of the molten metal to the tip of the nozzle.

BRIEF DESCRIPTION OF THE DRAWINGS

A full understanding of the invention can be gained from the following description of the preferred embodiment when read in conjunction with the accompanying drawings in which.

DETAILED DESCRIPTION

As used herein, the term "metal product" means primarily clad or unclad strip or slab made substantially of one or more metals, including without limitation, aluminum and aluminum alloys and can also include, in a broader sense, clad or unclad bar, foil or rod.

Figure 1:
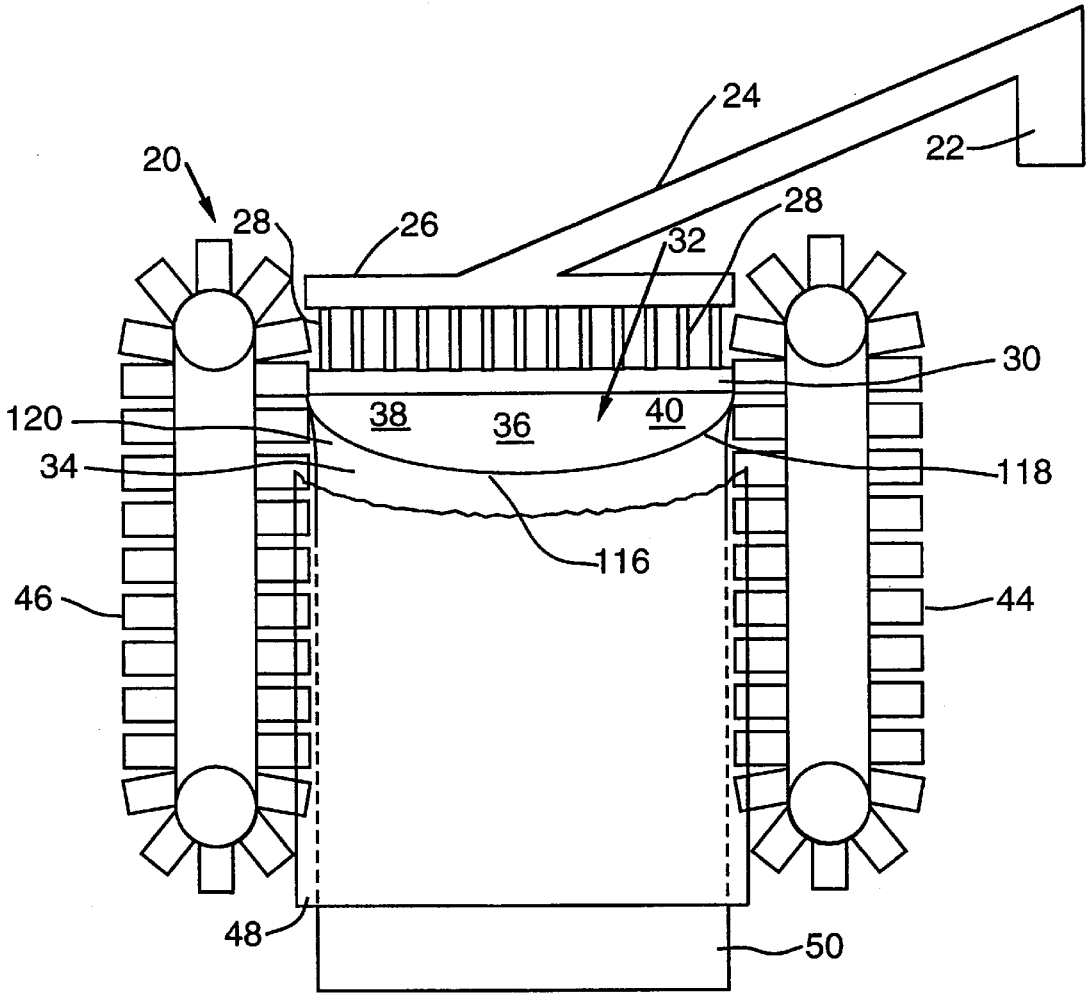
FIG. 1 is a partially schematic and partially cutaway elevational view of a twin belt caster.

Referring now particularly to FIG. 1, a partially schematic and partially cutaway elevational view of a twin belt caster 20 is shown. The caster 20 is supplied with molten metal from a holding furnace 22. The molten metal is delivered from the holding furnace 22 by a trough 24 to the tundish 26 of the caster 20. The molten metal then is directed by the tundish 26 into a plurality of tubes 28 and then into the nozzle 30. The nozzle 30 introduces the molten metal 32 into the mold 34 of the caster 20. The mold 34 includes a center portion 36 and, because this mold 34 is generally rectangular in cross-section in order to form slabs, a pair of outside edge portions 38 and 40. The mold 34 is defined by a pair of opposed movable side dams 44 and 46 and a pair of opposed movable belts, only one of which, belt 48, can be seen in FIG. 1. It will be appreciated that a stationary side dam can also be provided. The molten metal 32 solidifies into a metal product 50 in the mold 34 and is then moved out of the mold 34 at casting speed. Although a twin belt caster has been shown, it will be appreciated that the invention is not so limited, and can be used with other types of casters, such as block casters and roll casters.

For a more detailed description of a twin belt caster, reference is made to U.S. Pat. No. 4,964,456. For a more detailed description of the tundish 26, tubes 28 and nozzle 30 reference is made to U.S. Pat. No. 4,798,315. Finally, for a more detailed description of the movable side dams 44 and 46, reference is made to U.S. Pat. No. 4,794,978. All of the above three U.S. Patents are expressly incorporated by reference herein.

Figure 2:
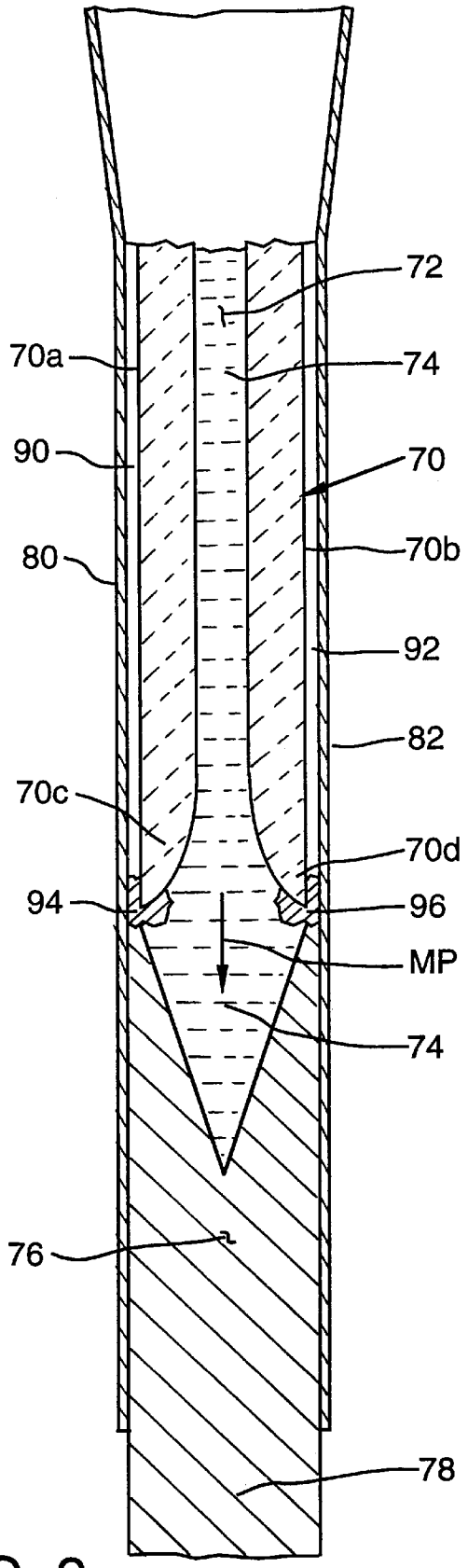
FIG. 2 is a cross-sectional view of a nozzle and belt showing the problem of freezing of molten metal to the tip of the nozzle.

The above-mentioned problem of molten metal freezing to the tip of a nozzle of a twin belt caster will be explained with reference to FIG. 2. FIG. 2 shows a very detailed cross-sectional view of a nozzle 70, similar to nozzle 30 shown in FIG. 1. The nozzle 70 defines a passageway 72 for the flow of molten metal 74 into the mold 76 of a caster. The molten metal 74 is solidified into a metal product 78 in the mold 76. The mold 76 is defined by a pair of opposed movable belts 80, 82 and a pair of movable or stationary side dams (not shown in this view).

Despite the devices and methods known in the prior art, a space 90, 92 can form between the outside surfaces 70*a* and 70*b* of the nozzle 70 and the respective belts 80 and 82. This space 90, 92 is shown exaggerated on FIG. 2 in order to clearly illustrate the problem. It has been determined that this space 90, 92 can range from 0 to 0.25 mm in width.

The ambient pressure in this space 90, 92 is approximately the atmospheric pressure of the environment where the caster is located. Because molten metal 74 is introduced into the mold 76, a metallostatic pressure "MP" is created, and thus, the molten metal has a tendency to flow into the space 90, 92. Because of this backflow, the molten metal 74 will freeze on the tips 70*c* and 70*d* of the nozzle 70 creating frozen metal product 94 and 96 disposed thereon.

Figure 4:
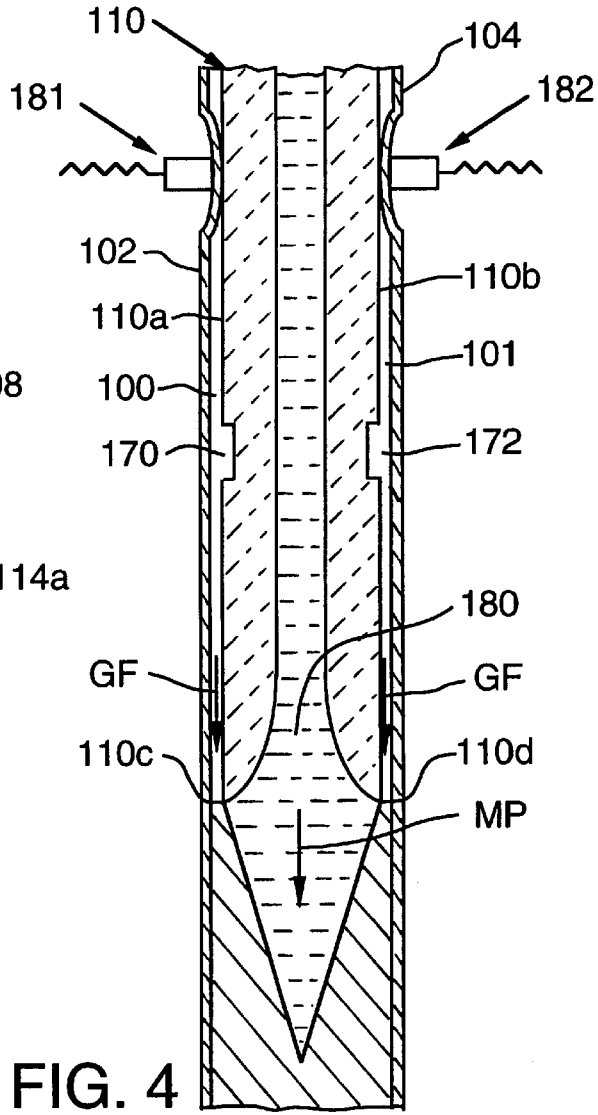
FIG. 4 is a cross-sectional view taken along line 4—4 of FIG. 3.
Figure 3:
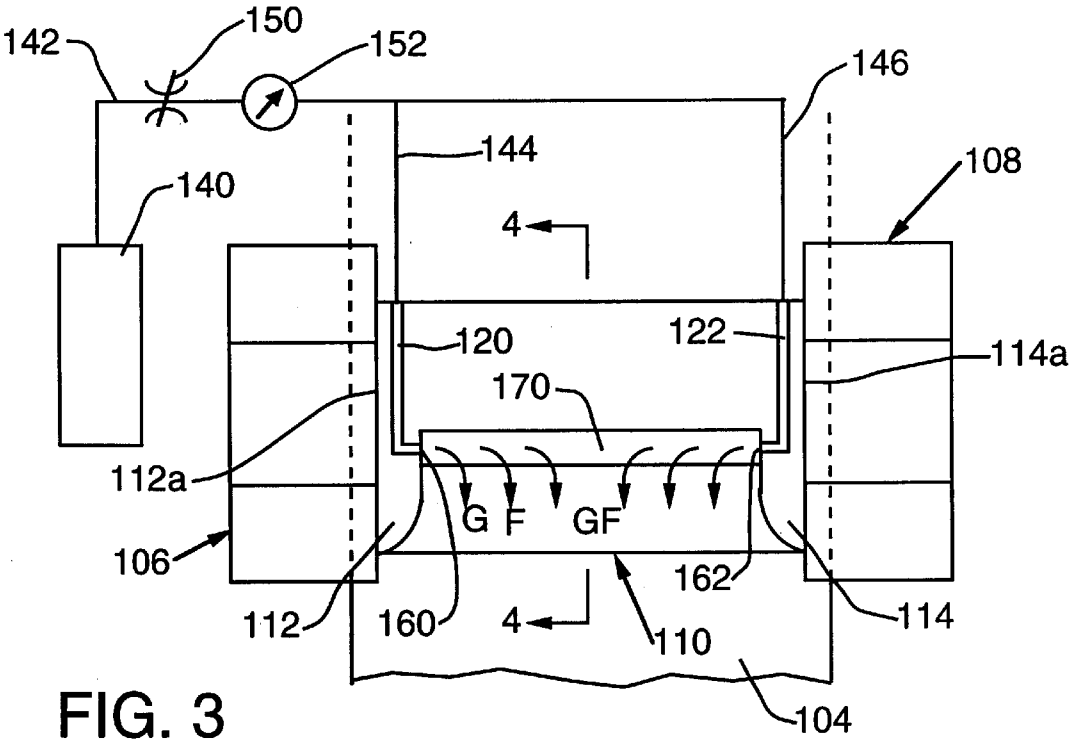
FIG. 3 is a detailed partially schematic view of one embodiment of the invention.

Referring to FIGS. 3 and 4, a first embodiment of the invention will be described. This first embodiment involves introducing a gas into the space 100, 101 (FIG. 4) defined by (i) the mold defining means, which in the case of a twin belt caster includes the belts 102, 104 (FIG. 4) and the side dams 106, 108 (FIG. 3) and (ii) the outside surfaces 110*a*, 110*b* of the nozzle 110 (FIG. 4). Referring now particularly to FIG. 3, the nozzle 110 includes a pair of metal tubes 112, 114 which are interposed between the nozzle 110 and the opposed side dams 106, 108. The tubes 112, 114 provide a wearing surface 112*a*, 114*a* for the side dams 106, 108 and thus protect the nozzle 110 from excess wear. The tubes 112, 114 each define respective gas passageways 120, 122. For a more detailed description of this arrangement reference is made to commonly owned U.S. patent application Ser. No. 08/566,776, and now issued as U.S. Pat. No. 5,787,961, the disclosure of which is expressly incorporated by reference herein.

Referring again to FIGS. 3 and 4, the embodiment shown includes a gas supply, such as tank 140 with a gas supply line 142 attached thereto. The gas supply line 142 has two branches, line 144 and line 146 which feed gas into respective gas passageways 120 and 122 of tubes 112 and 114. Gas supply line 142 also includes a valve 150 and a pressure meter 152 for controlling the flow of the gas into the branch lines 144 and 146. The passageways 120, 122 each have an opening 160, 162 through which the gas exits the passageways 120, 122. As can be seen in FIGS. 3 and 4, nozzle 110 includes grooves 170, 172 defined therein. After the gas exits openings 160, 162, it enters the grooves 170, 172. From there the gas flows into spaces 100, 101 as indicated by the arrows labelled "GF" on FIGS. 3 and 4. This gas flow, which preferably has a pressure that is slightly less than the metallostatic pressure MP, resists backflow of the molten metal 180 into spaces 100, 101 and thus in turn resists freezing of the molten metal to the tips 110*c* and 110*d* of the nozzle 110. Seals 181 and 182 (such as those disclosed in U.S. Pat. No. 4,785,873, the disclosure of which is incorporated by reference herein) are provided in order for the gas to flow towards the tips 110*c* and 110*d* and not out the upper part of spaces 100 and 101.

In practice, for each ten and one half inches of molten metal head, a metallostatic pressure of 1 psi is created. Thus, the pressure of the gas flow GF into space 100, 101 can be regulated to provide enough pressure to resist backflow and molten metal freezing to the nozzle tips 110*c*, 110*d*. As mentioned above, it is preferred that the pressure of the gas flow GF be slightly less than the metallostatic pressure MP. If the pressure of the gas flow GF is greater than the metallostatic pressure, the gas may enter the nozzle 110, which is undesirable because bubbles are created which can cause voids in the as-cast slab.

Figure 5:
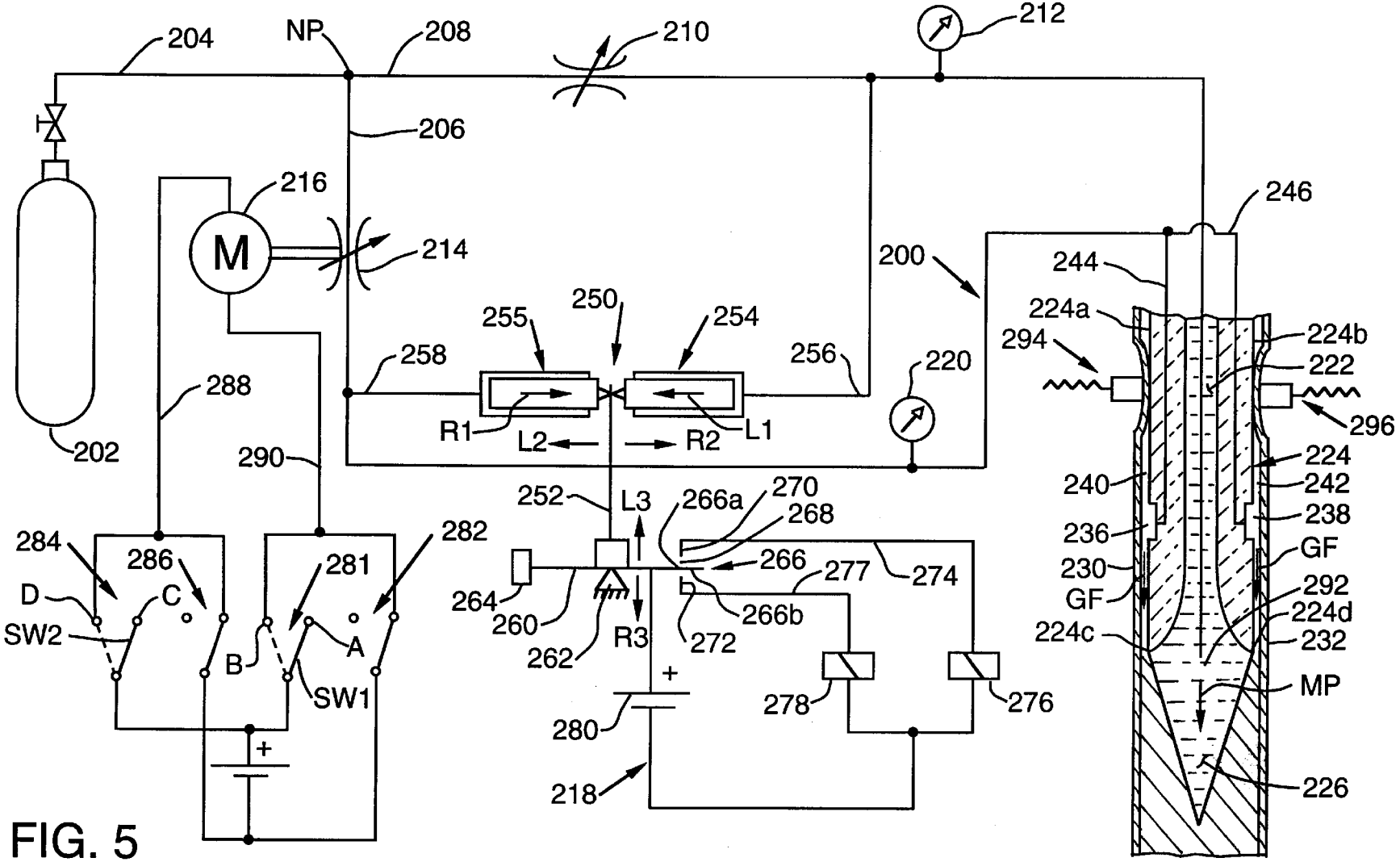
FIG. 5 is a schematic view, partially in section, of another embodiment of the invention showing one version of the automatic, self-adjusting gas pressure control means.
Figure 6:
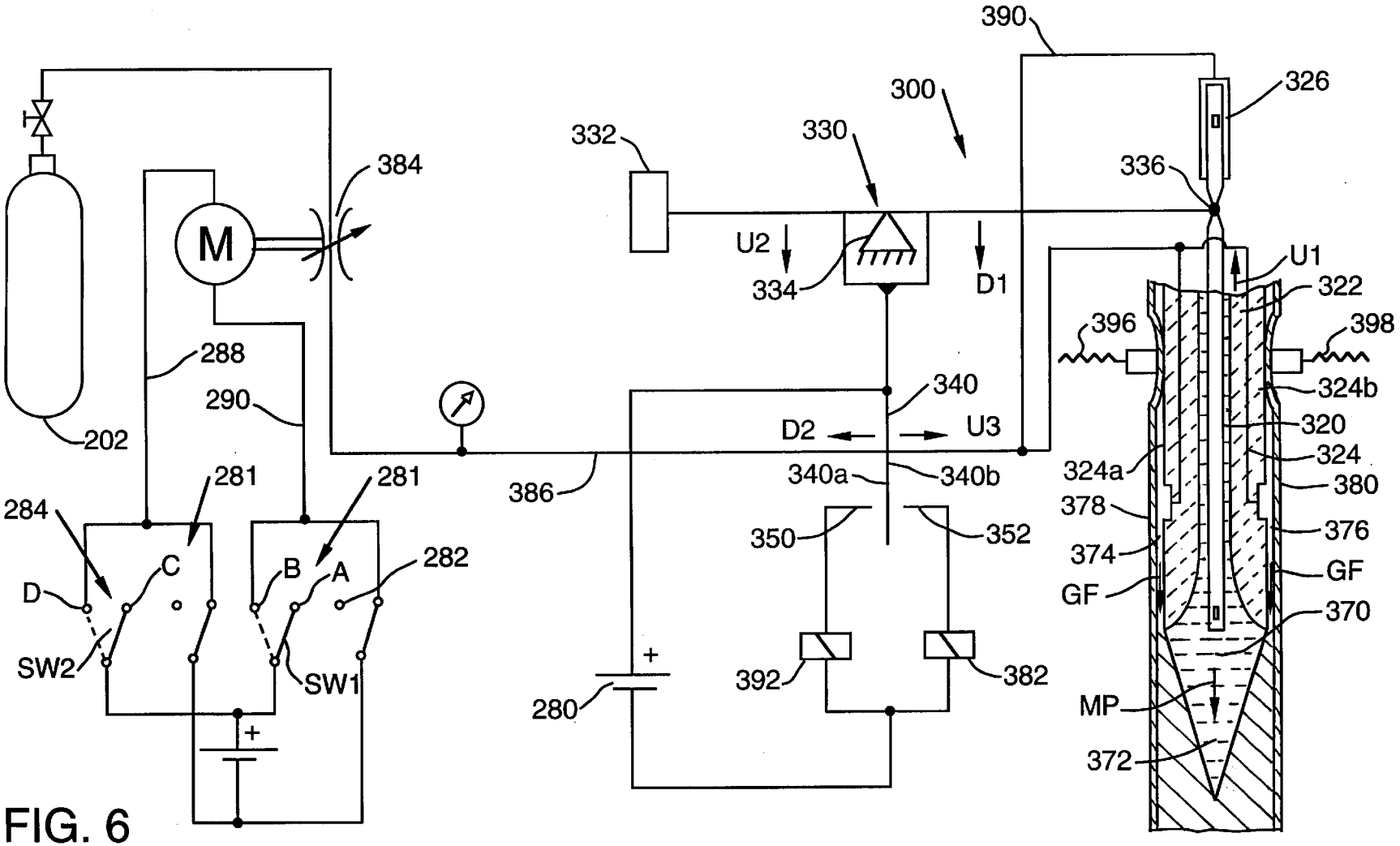
FIG. 6 is a schematic view, partially in section, of another embodiment of the invention showing another version of the automatic, self-adjusting gas pressure control means.

FIGS. 5 and 6 show alternate embodiments of the invention which involve automatic control of the pressure of the gas flow GF which is responsive to the metallostatic pressure MP. Referring now to FIG. 5, a schematic drawing of a gas pressure control means 200 is shown. The gas control means 200 includes a gas supply which preferably is a tank 202 containing an inert gas, preferably argon. A gas supply line 204 is connected to the tank 202. Gas supply line 204 then branches at node point "NP" into a nozzle gas tube 206 and a mold gas tube 208. Mold gas tube 208 includes a valve 210 and a pressure meter 212 and nozzle gas tube 206 includes a valve 214 controlled by a motor 216 which in turn is controlled by a relay circuit means 218, which will be explained in further detail below. The nozzle gas tube 206 also includes a pressure meter 220.

The mold gas tube 208 extends through the passageway 222 defined by the nozzle 224 and into the mold 226 of the twin belt caster, the mold 226 being defined by a pair of opposed belts 230, 232 and a pair of side dams (not shown in this view). As with the embodiment shown in FIGS. 3 and 4, the nozzle 224 has two grooves 236, 238. In addition, as was described with respect to FIGS. 3 and 4, spaces 240, 242 (again, exaggerated to clearly illustrate the point) are created between belts 230, 232 and the nozzle outside surfaces 224*a* and 224*b*.

The nozzle gas tube 206, after the pressure meter 220, also branches into two branch supply lines 244, 246. These branch supply lines 244, 246 are then connected to tubes (not shown in this view) similar to tubes 112 and 114 of FIGS. 3 and 4. In this way, the gas in the branch supply lines 244, 246 is introduced into passageways (similar to passageways 120, 122 in FIGS. 3 and 4, but not shown in FIG. 5) through openings (similar to openings 160, 162 in FIGS. 3 and 4, but not shown in FIG. 5) into grooves 236, 238 and then into spaces 240, 242.

This embodiment of the invention provides an automatic, self-adjusting gas pressure control means. Referring again to FIG. 5, balance means 250 responsive to the gas pressure in the mold gas tube 208 and the nozzle gas tube 206 is provided in order to insure that the right amount of gas pressure is maintained at the nozzle tips 224*c*, 224*d*. The balance means 250 include a balance rod 252, a first piston 254 operatively associated with the balance rod 252 and a second piston 255 operatively associated with the balance rod 252.

A first piston gas supply tube 256 is provided having a first end in communication with the first piston 254 and a second end in communication with the mold gas tube 208. The second piston gas supply tube 258 has a first end in communication with the second piston 255 and a second end in communication with the nozzle gas tube 206.

The balance rod 252 is connected to a balance 260 having a fulcrum 262, a weighted end 264 and a contact end 266. The balance 260 can pivot about the fulcrum 262 when the balance rod 252 is moved by the first piston 254 or the second piston 256. The contact end 266 includes an upper surface 266*a* and a lower surface 266*b*. The contact end 266 can move between the space 268 created by an upper contact 270 and a lower contact 272. Upper contact 270 is connected by line 274 to a first relay coil 276. The lower contact 272 is connected by line 277 to a second relay coil 278. The relay circuit 218 includes a power source, such as a battery 280, to energize the circuit upon contact of the contact end 266 with either the upper contact 270 or the lower contact 272. The first relay coil 276 has a pair of first relay contacts 281, 282 and the second relay coil 278 has a pair of second relay contacts 284, 286. The relay circuit 218 controls the motor 216 of the valve 214 via lines 288, 290.

The operation of this embodiment of the invention will now be explained. Initially, gas from the tank 202 is introduced into supply line 204. This gas flows into the mold gas tube 208 but not nozzle gas tube 206 as the valve 214 is initially in a closed position. Preferably, ½ cc/sec of gas is introduced into the mold gas tube 208 before introducing molten metal into the mold 226. Once molten metal 292 is introduced into the mold 226, the metallostatic pressure MP of the molten metal 292 will cause the pressure in the mold gas tube 208 to increase. Also, because of the metallostatic pressure, the molten metal 292 will backflow into spaces 240 and 242. The automatic gas pressure control means 200 of the invention provides a countervailing gas pressure, indicated by GF to resist this backflow. Seals 294 and 296, similar to seals 181 and 182 in FIG. 4, are also provided to insure that the gas does not flow out of the upper portion of spaces 240 and 242 without reaching the tips of the nozzle. The automatic gas pressure control means also provides a mechanism to stop the flow of gas into the space 240, 242 when the gas pressure therein is greater than the metallostatic pressure MP.

Referring again to FIG. 5, the increased pressure in the mold gas tube 208 will be introduced into first piston gas supply tube 256, thus causing first piston 254 to move to the left as shown by the arrow L1 in FIG. 5. This movement of the first piston 254 moves the balance rod toward the left as indicated by arrow L2, thus pivoting the balance upward, as shown by the arrow L3 in FIG. 5. When the upper surface 266*a* of the contact end 266 of the balance 260 contacts upper contact 270, the first relay coil 276 is energized, which in turn causes switch SW1 to move from contact A to contact B, as shown in phantom in FIG. 5. When this occurs, the circuit is completed, and motor 216 causes valve 214 to move from its initial closed position to an open position. This allows gas to flow into the nozzle gas tube 206 and eventually into spaces 240 and 242 to resist molten metal from freezing on the nozzle tips 224*c*, 224*d*. At the same time, gas flows into the second piston gas supply tube 258 and into the second piston 255 to cause second piston 255 to move to the right as shown by arrow R1 of FIG. 5. This will in turn move the balance rod 252 to the right (arrow R2) causing the balance 260 to now pivot downwardly (arrow R3) so that upper contact surface 266*a* no longer makes contact with upper contact 270. This deenergizes the first relay coil 276 which in turn causes switch SW1 to move from contact point B to A. This turns off the motor 216, which still leaves the valve 214 in an open position. The balance 260 continues to move downwardly until lower contact surface 266*b* of the balance 260 contacts lower contact 272. Once contact is made, second relay coil 278 is energized causing switch SW2 to move from contact C to D which then energizes the motor 216 to close the valve 214 and thus discontinue gas flow into the nozzle gas tube 206. Again, the pressure will increase in mold gas tube 208 causing the first piston to move to the left (arrow L1), balance rod 252 to move to the left (arrow L2) which will pivot balance 260 upwardly (arrow L3). Once contact between the lower contact surface 226*b* of balance and the lower contact 272 is broken, second relay 278 is deenergized, causing switch SW2 to move from contact D to contact C. This will leave the valve in the closed position. In order to avoid hysteresis, a timer or a dead band mechanism can be used.

This back and forth movement continues in order to control precisely the gas pressure at the nozzle tips 224*c*, 224*d*.

It will be appreciated that the balancing means provides an automatic self-adjusting method of controlling the gas pressure near the tips of the nozzle. This control will insure that molten metal is resisted from freezing to the nozzle tips.

FIG. 5 shows a specific embodiment (i.e., balance means 250) which is responsive to the gas pressure in the mold gas tube 208 and nozzle gas tube 206. It will be appreciated, however, that the invention is not limited to the balance means 250 shown in FIG. 5 but can be any sensor means that is responsive to the gas pressure in mold gas tube 206 and nozzle gas tube 208, for example, a diaphragm or a mercury sensor switch.

FIG. 6 shows another embodiment of the gas pressure control means 300. In this embodiment a mold rod 320 is disposed in the molten metal passageway 322 formed by the nozzle 324. The mold rod 320 is preferably made of nickel alloy, coated with a ceramic material. The mold rod 320 is connected to a piston 326. A balance 330, including a weighted end 332, a fulcrum 334 and a piston attachment end 336 is also provided. Similar to the embodiment shown in FIG. 5, a balance rod 340 is connected to the balance 330. The balance rod 340 can move between two contacts 350, 352, with a left surface 340*a* of the balance rod 340 adapted to contact left contact 350 and a right surface 340*b* of the balance rod 340 adapted to contact right contact 352. The structure of the remainder of the relay circuit is similar to the relay circuit 218 shown in FIG. 5 and will not be set forth in detail at this point.

In operation, when molten metal 370 is introduced into the mold 372, the metallostatic pressure MP will tend to create a backflow into spaces 374, 376 which is defined by belts 378, 380 and the nozzle surfaces 324*a* and 324*b*. The metallostatic pressure MP will also cause the mold rod 320 to move upwardly (arrow U1), thus pivoting balance in the direction of arrow U2 on FIG. 6. This, in turn, will cause balance rod 340 to move towards the right (in the direction of arrow U3). Once balance rod surface 340*b* contacts the right contact 352, first relay 382 is energized which in turn (as was explained above with respect to FIG. 5) opens the valve 384 allowing gas to flow into the nozzle gas tube 386 and eventually into space 374, 376. Seals 396 and 398, similar to seals 294 and 296 in FIG. 5, are again provided to insure that the gas does not flow out of the upper portion of spaces 374 and 376 without reaching the tips of the nozzle. The gas flowing into nozzle gas tube 386 will also flow into pivot gas tube 390 in order to counteract the upward movement of the piston 326. This gas pressure may eventually move the balance 330 downward, in the direction of arrow D1. This, in turn, will move the balance rod to the left in FIG. 6 as shown by arrow D2. When the surface 340*a* of the balance rod 340 contacts left contact 350, the second relay 292 is energized which in turn closes the valve 384, as was described above with respect to FIG. 5.

It will be appreciated that a caster has been disclosed including a gas delivery means to resist freezing of molten metal to the tip of a nozzle and an associated method.

An associated method of the invention is also provided. The method comprises providing a caster, such as (but not limited to) a twin belt caster and solidifying molten metal in the mold of the caster. While the molten metal is solidified, a gas, preferably argon, is introduced into the space between the mold defining means and the nozzle so that freezing of the molten metal to the tip of the nozzle is resisted.

While specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A caster comprising:

a mold to receive molten metal therein;

a nozzle for delivering said molten metal into said mold under metallostatic pressure, said nozzle including a tip disposed in said mold and defining a space therewith between the mold and the tip; and means for delivering a gas to said space, said gas delivering means including:

a mold gas tube having (i) a first end in communication with a gas supply for supplying gas having a pressure into said mold gas tube and (ii) a second end through which gas from said gas supply is introduced into said mold;

a nozzle gas tube having (i) a first end in communication with said gas supply and (ii) a second end for delivering gas from said gas supply into said space;

sensor means responsive to said gas pressure in said mold gas tube and gas pressure in said nozzle gas tube; and means, responsive to said sensor means, for controlling the gas pressure in said nozzle gas tube to be slightly less than the pressure in said mold tube, whereby backflowing of said molten metal into said space is resisted.

2. The caster of claim 1, wherein said gas is argon gas.

3. The caster of claim 1, wherein said caster is a belt caster and said mold comprises a pair of opposed movable belts and a pair of opposed side dam means.

4. The caster of claim 1, wherein said sensor means is a balance means including:

a balance rod;

a first piston operatively associated with said balance rod;

a first piston gas supply tube having (i) a first end in communication with said first piston and (ii) a second end in communication with said mold gas tube such that said first piston and said balance rod can move responsive to gas pressure in said mold gas tube;

a second piston operatively associated with said balance rod;

a second piston gas supply tube having (i) a first end in communication with said second piston and (ii) a second end in communication with said nozzle gas tube such that said second piston and said balance rod can move responsive to gas pressure in said nozzle gas tube;

a balance connected to said balance rod, said balance adapted to move between (i) a first position responsive to the movement of said first piston and (ii) a second position responsive to the movement of said second piston;

gas supply control means including a valve operatively associated with said nozzle gas tube; and means for energizing said gas supply control means to open and close said valve responsive to the position of said balance.

5. The caster of claim 4, wherein said energizing means is a pair of relays each having two contacts, a first said relay being energized when said balance is in said first position and a second said relay being energized when said balance is in said second position.

6. The caster of claim 5, wherein said first relay and said second relay are deenergized when said balance is intermediate said first position and said second position.

7. The caster of claim 6, wherein said gas is argon gas.

8. The caster of claim 1, wherein said gas delivering means includes:

a mold rod which moves responsively to said metallostatic pressure of said molten metal in said mold;

a piston operatively associated with said mold rod which moves responsively to said movement of said mold rod;

a piston gas tube having (i) a first end in communication with said nozzle gas tube and (ii) a second end in communication with said piston;

a balance operatively associated with said piston, said balance adapted to move between (i) a first position responsive to the movement of said piston in a first direction and (ii) a second position responsive to the movement of said piston in a second direction which is opposite of said movement of said piston in said first direction;

a valve in said gas supply operatively associated with said nozzle gas tube; and means for energizing said valve to open and close said valve responsive to the position of said balance.

9. The caster of claim 8, wherein said energizing means is a pair of relays each having two contacts, a first said relay being energized when said balance is in said first position and a second said relay being energized when said balance is in said second position.

10. The caster of claim 9, wherein said first relay and said second relay are deenergized when said balance is intermediate said first position and said second position.

11. The caster of claim 8, wherein said gas is argon gas.

12. The caster of claim 8, wherein said mold rod is made of nickel alloy coated with a ceramic material.

13. A caster comprising:

a mold comprising a pair of opposed movable belts and a pair of opposed side dams for receiving molten metal and casting a metal product downwardly form the mold;

a nozzle for delivering said molten metal into said mold under metallostatic pressure, said nozzle having a tip disposed between said belts, with a space between the tip and the belts on both sides of the tip;

a gas supply providing gas pressure into said space;

means for measuring said metallostatic pressure of said molten metal in said mold adjacent said tip; and means for controlling the gas pressure in said space to be slightly less than said metallostatic pressure to resist backflow of molten metal into said space.

14. A caster as set forth in claim 13 which includes a mold gas tube having one end in communication with said gas supply and another end in communication with said molten metal in aid mold adjacent said tip, and a nozzle gas tube having one end in communication with said gas supply and another end in communication with said space.

15. A caster as set forth in claim 14 in which said tip has a horizontally extending groove in it on opposite sides of the tip.

* * * * *